US005409161A

United States Patent [19]

Haskett

[11] Patent Number: 5,409,161

[45] Date of Patent: Apr. 25, 1995

[54] PAPER CADDY

[76] Inventor: Calvin E. Haskett, 320 E. 14th Ave., Mitchell, S. Dak. 57301

[21] Appl. No.: 128,095

[22] Filed: Sep. 29, 1993

[51] Int. Cl.[6] ..... B65D 91/00

[52] U.S. Cl. ..... 232/1 C

[58] Field of Search ..... 232/1 C, 19, 33, 22, 232/42

[56] References Cited

U.S. PATENT DOCUMENTS

| | | | |
|---|---|---|---|
| 1,654,362 | 12/1927 | Crimmel | 232/19 |
| 1,656,426 | 1/1928 | Cunningham | 232/1 C |
| 2,296,700 | 9/1942 | Branstetter | 232/33 |
| 4,494,690 | 1/1985 | Dupuis | 232/1 C |
| 4,901,912 | 2/1990 | Pinard | 232/1 C |
| 5,150,834 | 9/1992 | Bourke | 232/1 C |

*Primary Examiner*—Flemming Saether

*Attorney, Agent, or Firm*—Michael I. Kroll

[57] ABSTRACT

A paper caddy for a newspaper and similar article adapted to be mounted to a doorknob of a door is provided, which consists of a receptacle having a compartment for receiving and retaining the newspaper and similar article therein. A structure is for securing the receptacle to the doorknob of the door. The receptacle will hang down below the doorknob, to allow removal of the newspaper and similar article from the receptacle.

7 Claims, 2 Drawing Sheets

PAPER CADDY

BACKGROUND OF THE INVENTION

1. Field of the Invention

The present invention relates generally to article receiving devices and more specifically it relates to a paper caddy.

2. Description of the Prior Art

Numerous article receiving devices have been provided in prior art that are adapted to retain newspapers and other articles to vertical surfaces, such as doors, walls and similar structures. While these units may be suitable for the particular purpose to which they address, they would not be as suitable for the purposes of the present invention as heretofore described.

SUMMARY OF THE INVENTION

A primary object of the present invention is to provide a paper caddy that will overcome the shortcomings of the prior art devices.

Another object is to provide a paper caddy which is a neat and convenient way to retain a newspaper and similar article to any particular doorknob on a door.

An additional object is to provide a paper caddy that is just slipped over a doorknob to make it far more appealing to an owner of an apartment complex as there are no permanent attachment problems, while it also can be used in hotels where complimentary papers are given to people who occupy rooms.

A further object is to provide a paper caddy that is simple and easy to use.

A still further object is to provide a paper caddy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
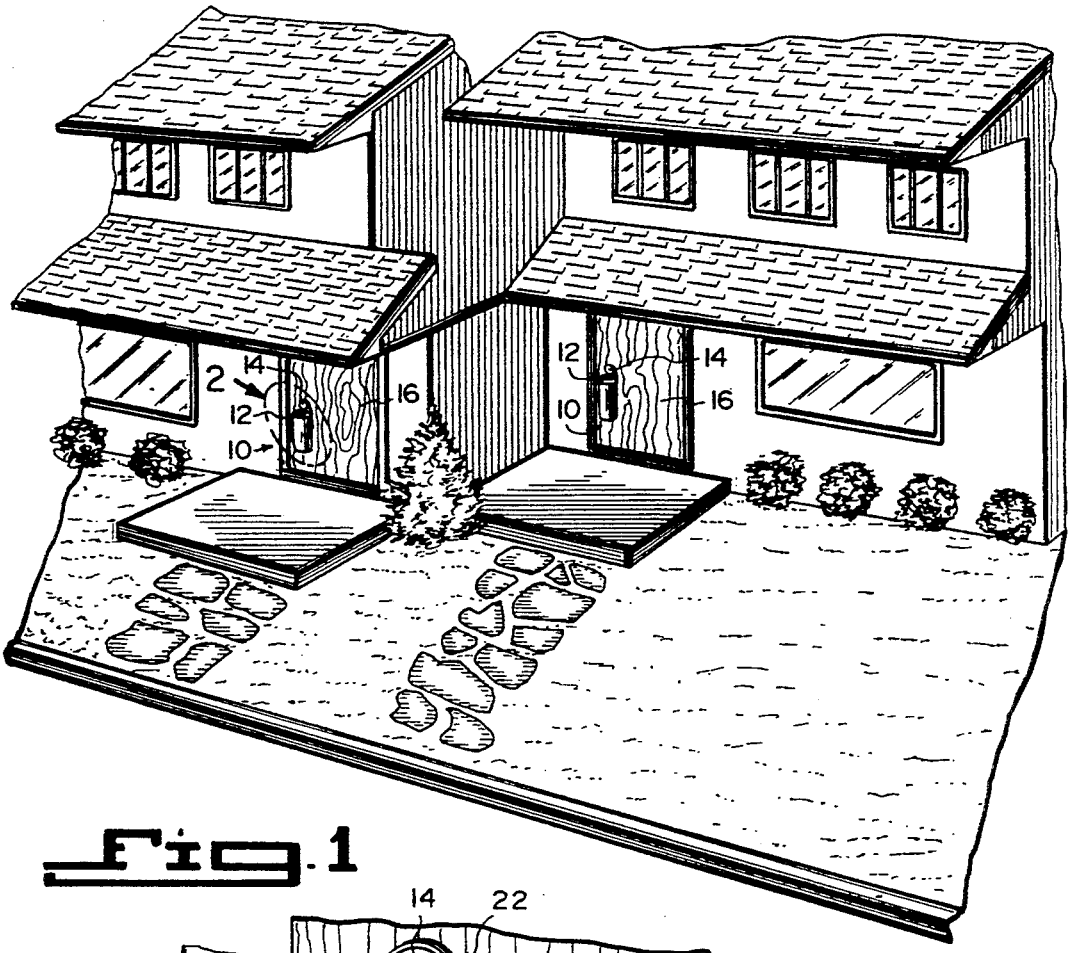
FIG. 1 is a perspective view of two buildings with the present invention in use installed on both entrance doorknobs.
Figure 2:
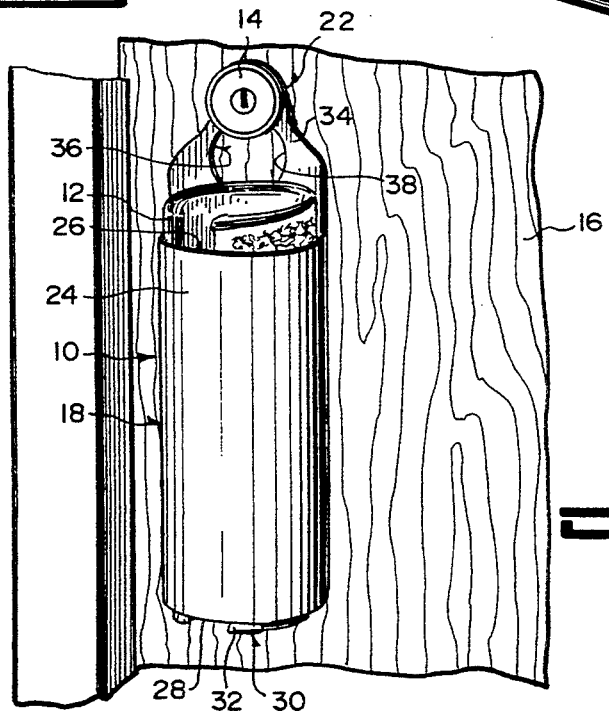
FIG. 2 is an enlarged perspective view as indicated by arrow 2 in FIG. 1.
Figure 3:
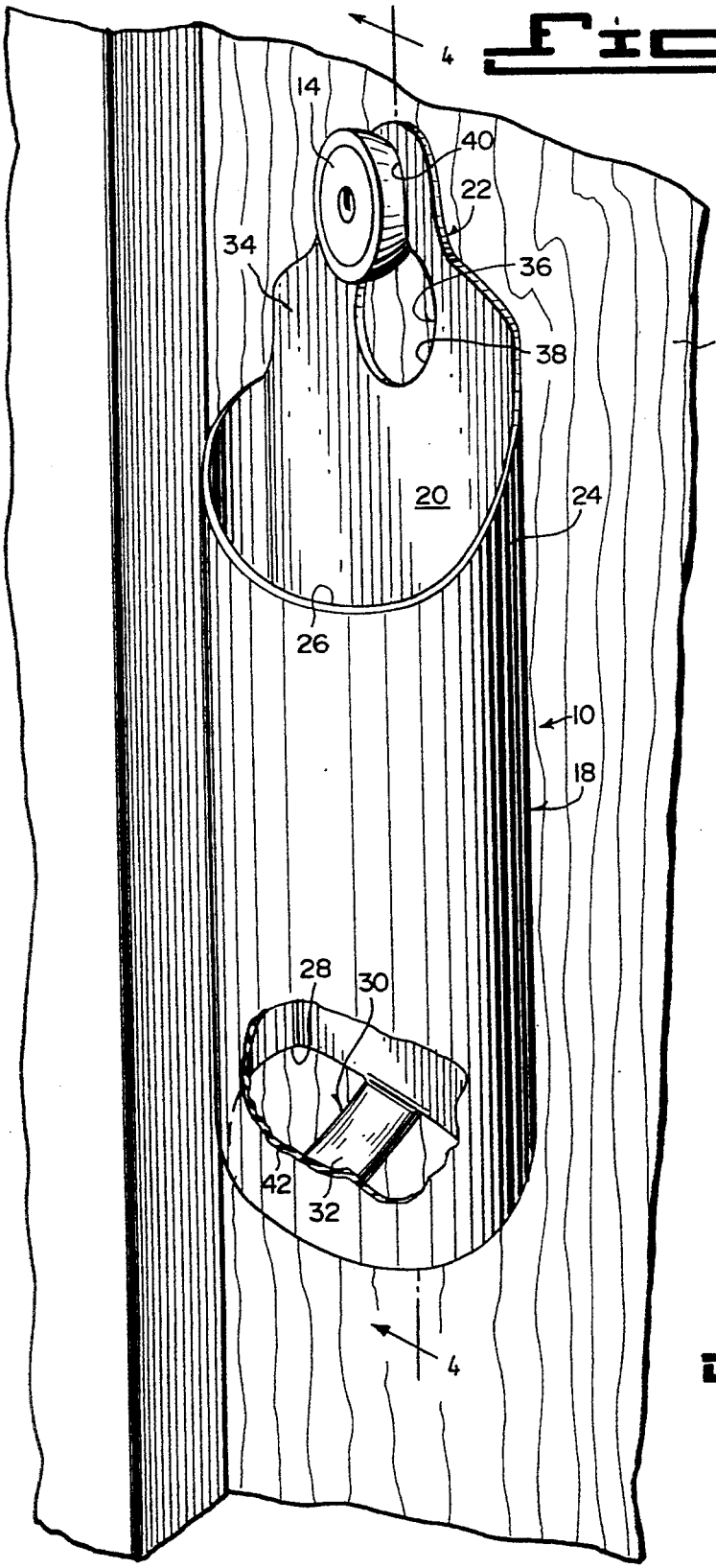
FIG. 3 is a further enlarged perspective view of the present invention similar to FIG. 2, which is broken away and the newspaper removed, so as to see the bottom strap therein.
Figure 4:
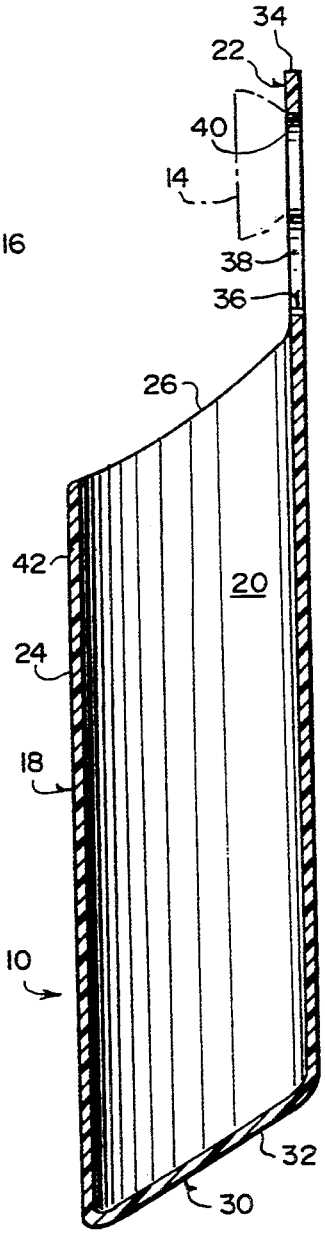
FIG. 4 is a cross sectional view taken along line 4—4 in FIG. 3, of the present invention per se.

Turning now descriptively to the drawings, in which similar reference characters denote similar elements throughout the several views, FIGS. 1 through 4 illustrate a paper caddy 10 for a newspaper 12 and similar article adapted to be mounted to a doorknob 14 of a door 16. The paper caddy 10 consists of a receptacle 18, having a compartment 20 for receiving and retaining the newspaper 12 and similar article therein. A structure 22 is for securing the receptacle 18 to the doorknob 14 of the door 16. The receptacle 18 will hang down below the doorknob 14, to allow removal of the newspaper 12 and similar article from the receptacle 18.

The paper caddy 10 will not interfere with the normal operation of the doorknob 14. This allows a person to leave it on the doorknob 14 at all times, or take it off when not expecting the newspaper 12 and similar article.

The receptacle 18 includes a generally upright hollow tube 24, having an open top end 26 and an open bottom end 28. A component 30 is for sealing the open bottom end 28 of the tube 24, so that the newspaper 12 and similar article can be rolled up and inserted into the open top end 26 of the tube 24 and be retained within the compartment 20 by the sealing component 30. The sealing component 30 is a strap 32 extending across the open bottom end 28 of the tube 24, to prevent the rolled up newspaper 12 and similar article from falling out of the bottom end 24 of the tube 24. The strap 32 will allow snow, rain and other small objects not intended to be retained, to exit the bottom end 28 of the tube 24.

The securing structure 22 is an extension member 34 extending upwardly from the open top end 26 of the tube 24. The extension member 34 has an aperture 36, to hook the extension member 34 onto the doorknob 14 of the door 16.

The tube 24 is sized to allow an upper portion of the rolled up newspaper 12 and similar article to extend above the open top end 26 of the tube 24 for easy removal. The extension member 34 is sized to allow the upper portion of the rolled up newspaper 12 and similar article which extends above the open top end 26 of the tube 24, to be spaced away from under the doorknob 14 of the door 16 for easy removal from the tube 24.

The aperture 36 in the extension member 34 has an enlarged lower opening 38 and a smaller upper opening 40, which overlaps with the enlarged lower opening 38. The doorknob 14 can fit past the enlarged lower opening 38 and engage with the smaller upper opening 40, when the tube 24 is manually pulled downwardly.

The tube 24, the strap 32 and the extension member 34 can all be fabricated out of a durable waterproof material 42, such as polyethylene plastic or plastic coated cardboard and can be completely disposable. The tube 24, the strap 32 and the extension member 34 are integral and fabricated out of the same durable waterproof material 42, which can be recycled.

OPERATION OF THE INVENTION

To use the paper caddy 10 the following steps should be taken:

1. Place the enlarged lower opening 38 of the extension member 34 over the doorknob 14 of the door 16.
2. Pull the extension member 34 downwardly, so that the smaller upper opening 40 engages with the doorknob 14 of the door 16.
3. Roll up the newspaper 12 and similar article.
4. Insert the rolled up newspaper 12 and similar article through the open top end 26 of the tube 24 and into the compartment 20.
5. Make sure that the bottom of the rolled up newspaper 12 and similar article rests upon the strap 32.
6. Remove the rolled up newspaper 12 and similar article from the tube 24.

7. Release the extension member 34 from the doorknob 14 of the door 16 by lifting the tube 24 upwardly, so that the enlarged lower opening 38 of the extension member 34 is in alignment with the doorknob 14.
8. Pull the extension member 34 away from the doorknob 14, so that the enlarged lower opening 38 will go past the doorknob 14, allowing the tube 24 to be removed therefrom.

LIST OF REFERENCE NUMBERS

10 paper caddy
12 newspaper
14 doorknob
16 door
18 receptacle
20 compartment in 18
22 securing structure
24 generally upright hollow tube
26 open top end of 24
28 open bottom end of 24
30 sealing component
32 strap
34 extension member
36 aperture in 34
38 enlarged lower opening of 36
40 smaller upper opening of 36
42 durable waterproof material It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A paper caddy in combination with a newspaper and mounted on a doorknob of a door, said caddy comprises:

a) a vertically extending receptacle means having a compartment for receiving and retaining the newspaper;

b) means for securing said receptacle means on said doorknob of the door, so that said receptacle will hang down below the doorknob not interfere with the normal operation of the doorknob;

c) said receptacle means being tubular in shape, open at the top to receive said newspaper when rolled up and open at the bottom, the bottom of said receptacle means having a strap extending thereacross to retain said newspaper within said receptacle means but allowing snow, rain and other small objects to exit said bottom; and d) said securing means comprising extension means extending upwardly from the top opening of said receptacle means, said extension means having an aperture to hook onto said doorknob and being of sufficient length so that said newspaper is completely below said doorknob and an upper portion of said newspaper extends above said top opening to allow the removal of said newspaper without interference by said doorknob, said aperture having an enlarged lower opening and a smaller upper opening which overlaps said enlarged lower opening, so that said doorknob can fit past said enlarged lower opening and engage with said smaller upper opening, when said tube is manually pulled downwardly.

2. A paper caddy as recited in claim 1, wherein said tube is fabricated out of a durable waterproof material.

3. A paper caddy as recited in claim 2, wherein said strap is fabricated out of a durable waterproof material.

4. A paper caddy as recited in claim 3, wherein said extension member is fabricated out of a durable waterproof material.

5. A paper caddy as recited in claim 4, wherein said tube, said strap and said extension member are integral and fabricated out of the same durable waterproof material, which can be recycled.

6. A paper caddy as recited in claim 5, wherein said durable waterproof material is polyethylene plastic.

7. A paper caddy as recited in claim 5, wherein said durable waterproof material is plastic coated cardboard.

* * * * *